United States Patent [19]

Haynes

[11] 4,233,760

[45] Nov. 18, 1980

[54] SHOE WITH REFLECTING MEANS

[76] Inventor: Joseph E. Haynes, 5945 Merle Dr., Toledo, Ohio 43623

[21] Appl. No.: 43,059

[22] Filed: May 29, 1979

[51] Int. Cl.[3] ..... A43B 23/00
[52] U.S. Cl. ..... 36/137
[58] Field of Search ..... 36/137; 350/98

[56] References Cited

U.S. PATENT DOCUMENTS

| | | | |
|---|---|---|---|
| 2,607,130 | 8/1952 | Pearson | 36/137 |
| 3,527,518 | 4/1968 | Tomlinson et al. | 36/137 |

FOREIGN PATENT DOCUMENTS

| | | | |
|---|---|---|---|
| 7500494 | 1/1975 | Netherlands | 36/137 |
| 301777 | 12/1954 | Switzerland | 36/137 |
| 1092482 | 11/1967 | United Kingdom | 36/137 |

*Primary Examiner*—Patrick D. Lawson
*Attorney, Agent, or Firm*—Wilson, Fraser, Barker & Clemens

[57] ABSTRACT

The invention concerns a shoe having light reflecting means on the upper portion and on the bottom sole portion thereof to reflect light from approaching vehicles to visually signal the wearer's presence. The shoe is particularly useful for athletic shoes, such as jogging shoes.

7 Claims, 3 Drawing Figures

SHOE WITH REFLECTING MEANS

BACKGROUND OF THE INVENTION

1. Field of the Invention

This invention relates to footwear and, particularly, to athletic shoes, such as jogging or running shoes.

Recently, the sport of jogging has become popular with an increasing proportion of the American population. Many jogging shoes are available with a variety of designs for the upper and sole and the lacing means. However, one problem still present for many joggers is the ability to be seen clearly by others, like motorists and bicycle riders, in early morning or late evening hours.

2. Description of the Prior Art

Previously, sporting shoes have been provided with a variety of special features to improve appearance, durability, ability to grip the roadway or other surface, and other aesthetic and functional improvements. For example, U.S. Pat. Nos. 4,085,527 to Rigg; 4,030,213 to Daswick; and 4,069,598 to Dassler, show various modifications to sport shoes to improve the traction characteristics.

U.S. Pat. No. 1,664,728 to Behr discloses placing twisted cords of loose fibrous material in preformed slots in a sport shoe sole to improve traction.

In addition to functional features, many aesthetic features have been added to shoes, not only sport shoes by other casual and formal styled footwear. For example, U.S. Pat. No. 1,977,995 to Morali discloses a formal shoe having colored glass ornaments along the upper portions thereof to reflect incident light to provide an ornamental effect.

SUMMARY OF THE INVENTION

The instant invention contemplates an improved athletic shoe, such as, for example, a jogging or running shoe having improved safety characteristics over known athletic shoes. The improved shoe includes a plurality of light reflective means affixed to the upper and sole portions of the shoe. The surfaces of the reflective means return incident light from an on coming auto, motorcycle, bicycle light, or similar light source to the source by reflection to visually signal the presence of the wearer of the shoe as he runs along his selected path of travel. As the front and rear portion of the sole are alternately elevated during the natural motion of the foot while running, the reflective surfaces are exposed to incident light from the auto or other light source. In one embodiment, the reflective surface is coated or impregnated into the material from which the sole is formed, while in another embodiment, reflective strips are inlaid into the sole.

It is an object of the present invention to provide an athletic shoe with improved night jogging safety characteristics.

It is another object of the present invention to provide a running or jogging shoe having reflective surfaces positioned along the sole of the shoe to alert approaching motorists of the presence of the athlete.

A further object of the invention is to provide a reflective surface on the sole of an athletic shoe such that when substantially all of the gripping treads formed on the sole of the shoe have degraded as the consequence of use, the reflective surface is still functional.

BRIEF DESCRIPTION OF THE DRAWINGS

The above, as well as other objects and advantages of the invention, will become readily apparent to one skilled in the art from reading the following detailed description of the present invention when considered in light of the accompanying drawings, in which.

DETAILED DESCRIPTION OF THE INVENTION

Referring to the Figures, there is illustrated an athletic shoe 10 having an upper 12 attached to a sole 14 which complements the shape of the human foot. A plurality of treads 16 can be spaced along the bottom surface of the sole 14. The treads 16 provide increased traction between the sole 14 and the running surface.

Figure 2:
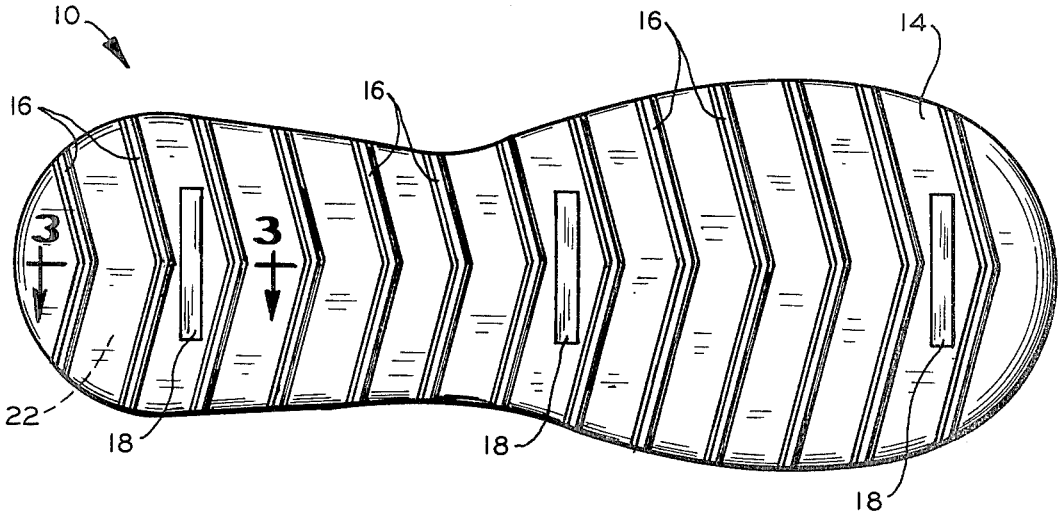
FIG. 2 is a bottom, plan view of the shoe shown in FIG. 1.
Figure 3:
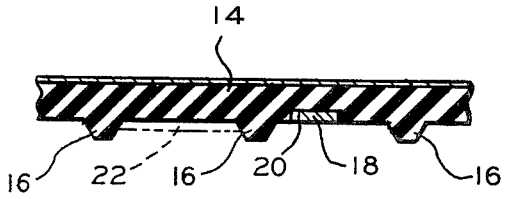
FIG. 3 is a partial sectional view taken along the line 3—3 in FIG. 2.

In accordance with the present invention, a plurality of reflective means 18 are spaced along the sole 14. The reflective means can be fabricated from any suitable material, such as, for example, reflective tape, plastic retroreflective prisms, or metallic chips, molded into or otherwise attached to the sole of the shoe. As illustrated in FIG. 2, the reflective means 18 can comprise a solid block or bar of reflective material which is inlaid into a cavity 20 formed in the bottom of the sole 14. Typically, the outer surface of each reflective bar is coplanar with the bottom surface of the sole 14. Thus, as the treads wear away under normal usage, the reflective surface is not subject to wear and thereby maintains its function of reflecting light to visually pinpoint the location of the wearer. Alternatively, high strength, abrasion resistant plastic films having reflective chips in their composition could be suitably affixed to the bottom surface 14 without inlaying. Such an externally positioned reflective surface is shown in phantom, designated by reference numeral 22 in FIG. 3, and is spaced between the gripping treads 16.

The placement of reflective surfaces on the sole of an athletic shoe provides an improved safety feature. When a jogger, or other athlete, is wearing the shoe during partially darkened conditions or total darkness, his position is continuously pinpointed by the reflection from the bottom of his shoes as his feet tilt forward off the surface of the pavement as he runs, thereby, reflecting light from an approaching vehicle so as to alert the driver to the athlete's presence.

Figure 1:
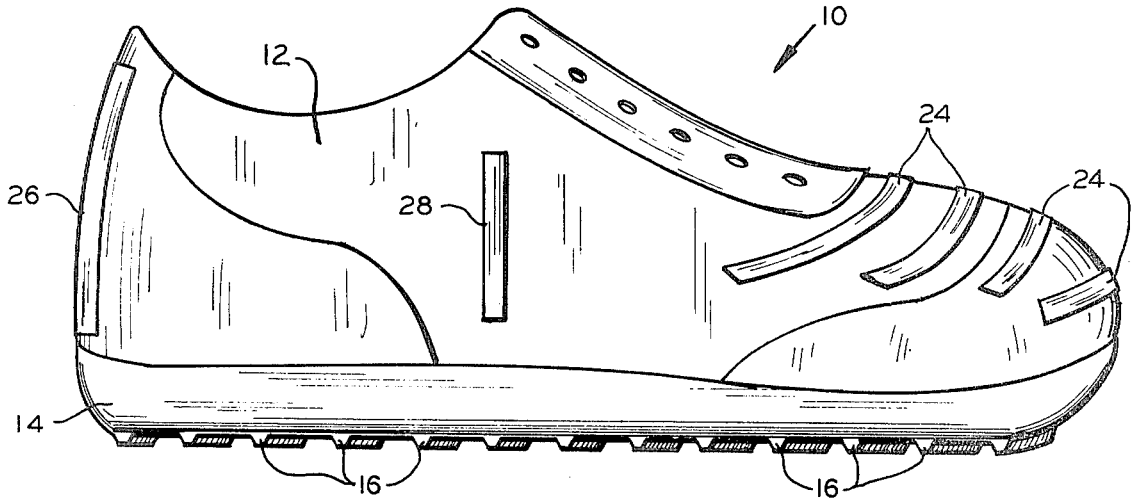
FIG. 1 is a side elevational view of an athletic shoe embodying the features of the present invention.

In addition to the reflective means on the bottom of the sole 14, the shoe 10 can also have reflective means attached to the upper 12. For example, as shown in FIG. 1, strips of reflective material 24 can be attached to the upper 12 at the toe for forward visibility. A reflective strip 26 can be attached to the back of the upper 12 for rear visibility and a strip 28 can be attached to the side of the upper 12 for side visibility. Of course, the reflective strips 24, 26 and 28 can take any desired shape and can also serve as ornamentation for the shoe.

In accordance with the provisions of the patent statutes, I have explained the principal and mode of operation of my invention, and have illustrated and described what I now consider to represent its best embodiments. However, I desire to have it understood that the invention may be practiced otherwise than as specifically illustrated and described without departing from the spirit or scope of the appended claims.

What is claimed is:

1. In a shoe having an upper and a sole, the improvement comprising: a pluarlity of cavities formed in the bottom surface of the sole and an individual bar of reflective material positioned in each of said cavities and attached to the bottom surface of the sole for reflecting incident light whereby the wearer of the shoe is visible from the front and rear as he travels in the path of a lighted vehicle.

2. The shoe defined in claim 1 including a plurality of upstanding, spaced-apart treads formed on the bottom surface of the sole and wherein said sheets of reflective material attached to the bottom of the sole are positioned between said treads.

3. The shoe defined in claim 1 including reflective means attached to the outer surface of the upper.

4. The shoe defined in claim 3 wherein said upper reflective means includes at least one strip of reflective material attached to the outer surface of the upper.

5. In a shoe having an upper and a sole, the improvement comprising: first means attached to the outer surface of the upper and second means attached to the bottom surface of the sole for reflecting incident light whereby the wearer of the shoe is visible as he travels in the path of a lighted vehicle and including a plurality of cavities formed in the bottom surface of the sole wherein said second means for reflecting includes an individual bar of reflective material positioned in each of said cavities.

6. The shoe defined in claim 5 wherein said first reflecting means includes a plurality of strips of reflective material attached to the outer surface of the upper.

7. In a shoe having an upper and a sole, the improvement comprising: first means attached to the outer surface of the upper and second means attached to the bottom surface of the sole for reflecting incident light whereby the wearer of the shoe is visible as he travels in the path of a lighted vehicle and including a plurality of upstanding, spaced-apart treads formed on the bottom surface of the sole and wherein said second means for reflecting includes a plurality of sheets of reflective material attached to the bottom of the sole, said sheets being positioned between said treads.

* * * * *